US005630488A

United States Patent [19]

Chen

[11] Patent Number: 5,630,488

[45] Date of Patent: May 20, 1997

[54] RETRACTABLE HANDLE POSITIONING STRUCTURE FOR LUGGAGE

[76] Inventor: Ding-Fang Chen, No. 422, Sec. 1, Chung-shan Rd., Tachia Chen, Taichung Hsien, Taiwan

[21] Appl. No.: 492,816

[22] Filed: Jun. 20, 1995

[51] Int. Cl.[6] ..... A45C 5/14; A45C 13/28

[52] U.S. Cl. ..... 190/115; 190/18 A; 190/39; 16/115; 280/655.1

[58] Field of Search ..... 190/18 A, 39, 190/115; 16/115; 280/37, 655, 655.1

[56] References Cited

U.S. PATENT DOCUMENTS

| | | | |
|---|---|---|---|
| 5,447,217 | 9/1995 | Chou | 190/18 A |
| 5,459,908 | 10/1995 | Chen | 16/115 |
| 5,500,981 | 3/1996 | Ho | 16/115 |
| 5,502,876 | 4/1996 | Wang | 16/115 |
| 5,513,873 | 5/1996 | Chen | 16/115 X |
| 5,526,908 | 6/1996 | Wang | 190/115 |

*Primary Examiner*—Sue A. Weaver
*Attorney, Agent, or Firm*—Bacon & Thomas

[57] ABSTRACT

A retractable handle positioning structure including two sleeves connected between a top mounting frame and a bottom mounting frame, two inner tubes joined by a hand grip and moved in and out of the sleeves, a control bar mounted in the top mounting frame and turned on its own axis, two longitudinal racks respectively mounted on the inner tubes inside the sleeves, and two locating blocks mounted around two opposite ends of the control bar and moved between the locking position in which the locating blocks are meshed with the racks to hold the inner tubes in position, and the unlocking position in which the locating blocks are disengaged from the racks for permitting the inner tubes to be moved relative to the sleeves.

1 Claim, 5 Drawing Sheets

RETRACTABLE HANDLE POSITIONING STRUCTURE FOR LUGGAGE

BACKGROUND OF THE INVENTION

Conventional luggage generally are generally equipped with rollers for moving on the ground and a carrying strap for pulling (see FIG. 1)

However, it is difficult to control the steering of luggage when pulling its carrying strap. FIG. 2 shows a retractable handle for luggage according to the prior art. When this structure of retractable handle is installed in luggage, the luggage can be conveniently moved on the ground and its steering direction can be easily controlled. However, this structure of retractable handle is still not satisfactory in function. Because this retractable handle can only be set between the collapsed position and the fully extended position, it cannot fit people of different heights.

SUMMARY OF THE INVENTION

The present invention has been accomplished to,provide a retractable handle which eliminates the aforesaid drawback. According to the preferred embodiment of the present invention, the retractable handle positioning structure comprises two sleeves connected between a top mounting frame and a bottom mounting frame, two inner tubes joined by a hand grip and moved in and out of the sleeves, a control bar mounted in the top mounting frame and turned on its own axis, two longitudinal racks respectively mounted on the inner tubes inside the sleeves, and two locating blocks mounted around two opposite ends of the control bar and moved between the locking position in which the locating blocks are meshed with the racks to hold the inner tubes in position, and the unlocking position in which the locating blocks are disengaged from the racks for permitting the inner tubes to be moved relative to the sleeves.

DETAILED DESCRIPTION OF THE PREFERRED EMBODIMENT

Figure 1:
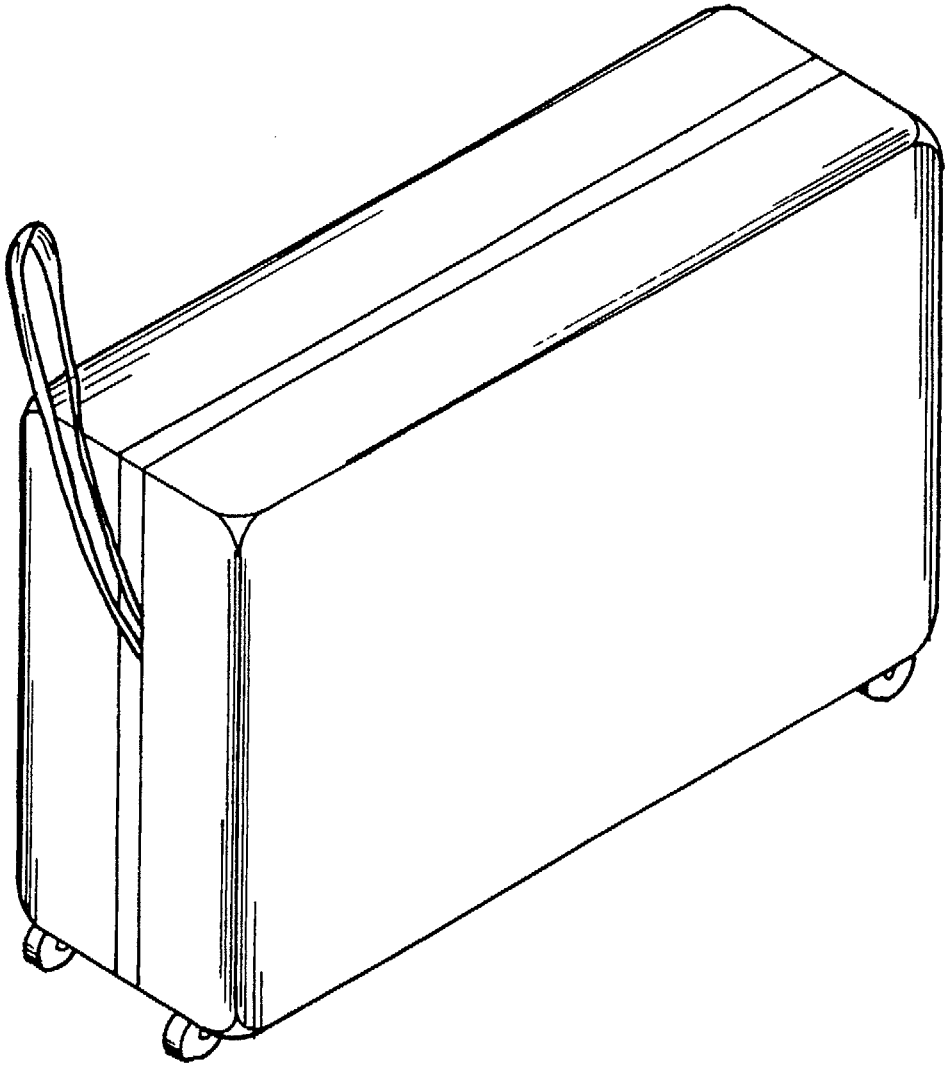
Fig. 1 PRIOR ART
FIG. 1 shows a conventional luggage equipped with rollers and a carrying strap.
Figure 2:
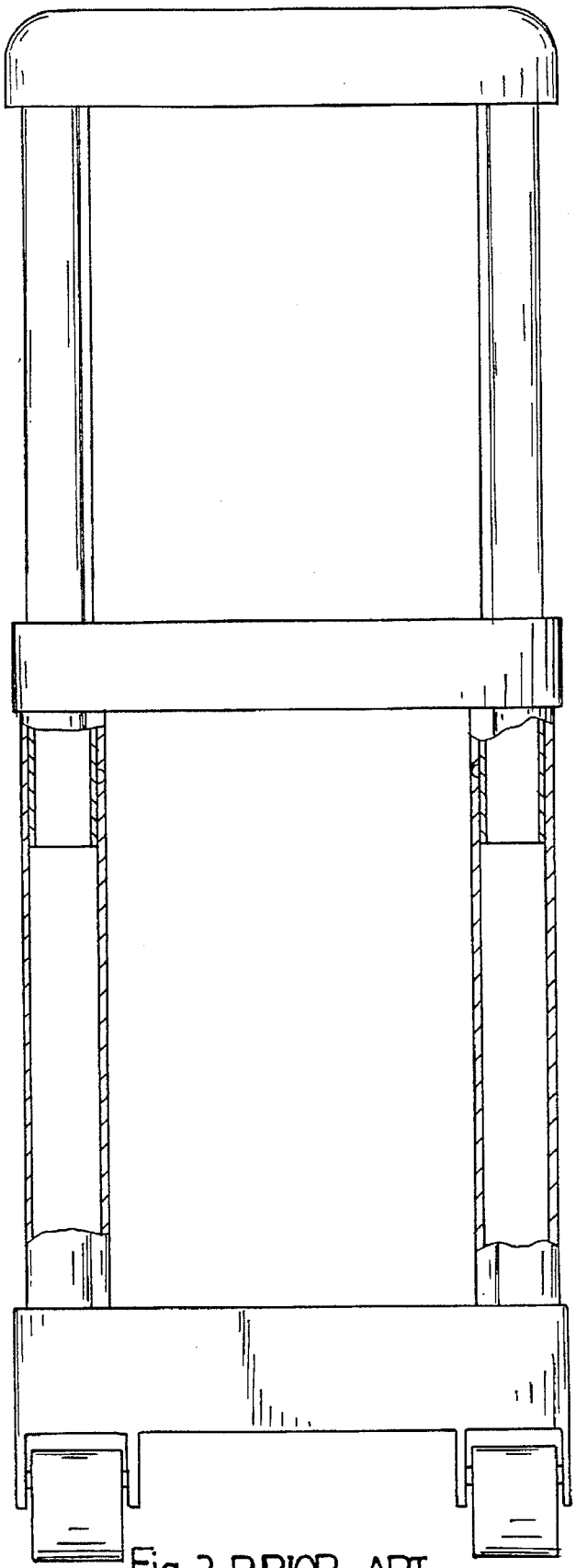
Fig. 2 PRIOR ART
FIG. 2 is plain view of a retractable handle for luggage according to the prior art.
Figure 3:
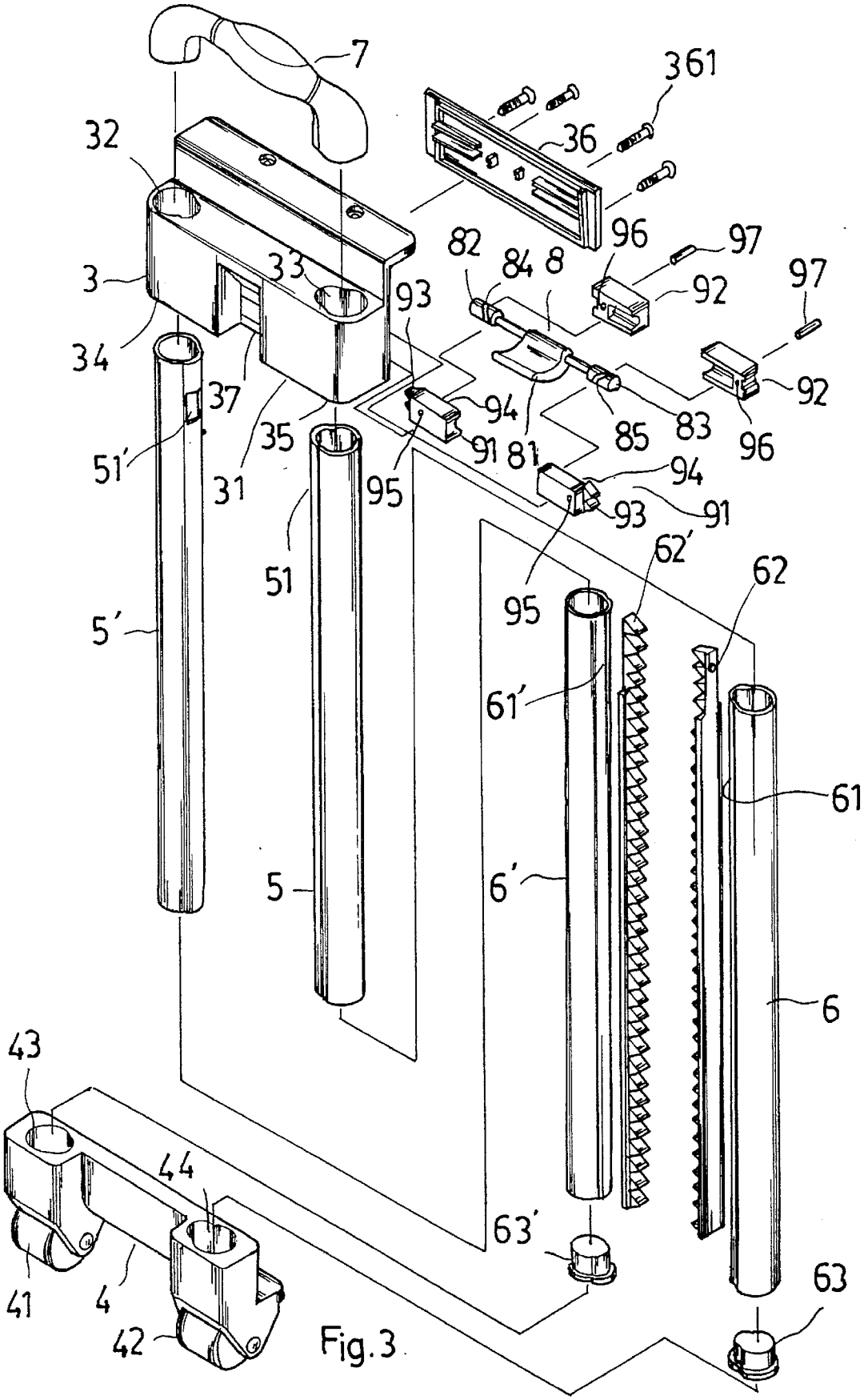
FIG. 3 is an exploded view of a retractable handle positioning structure according to the present invention.
Figure 4:
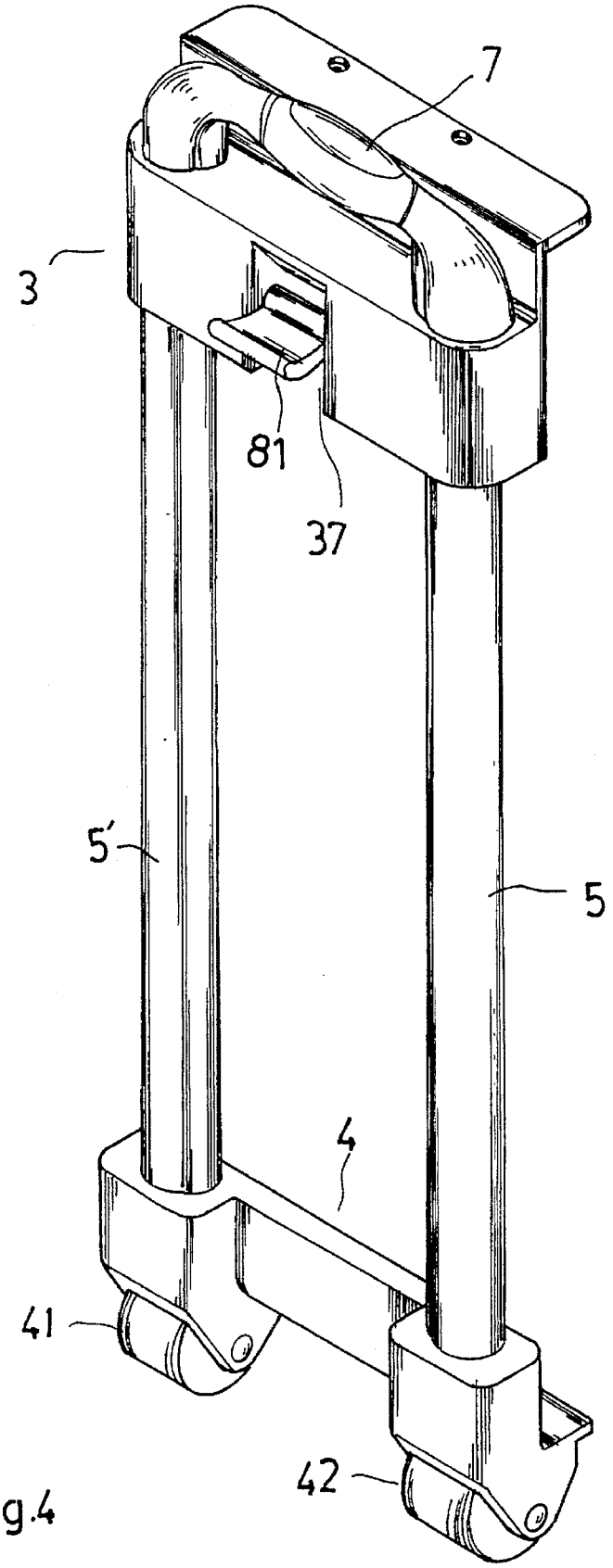
FIG. 4 is an elevational assembly view of the retractable handle positioning structure shown in FIG. 3.

Referring to FIGS. 3 and 4, a retractable handle positioning structure in accordance with the present invention is generally comprised of a top mounting frame 3, a bottom mounting frame 4, two sleeves 5 and 5', two inner tubes 6 and 6', a hand grip 7, a control bar 8, and two locating blocks 9.

Figure 5:
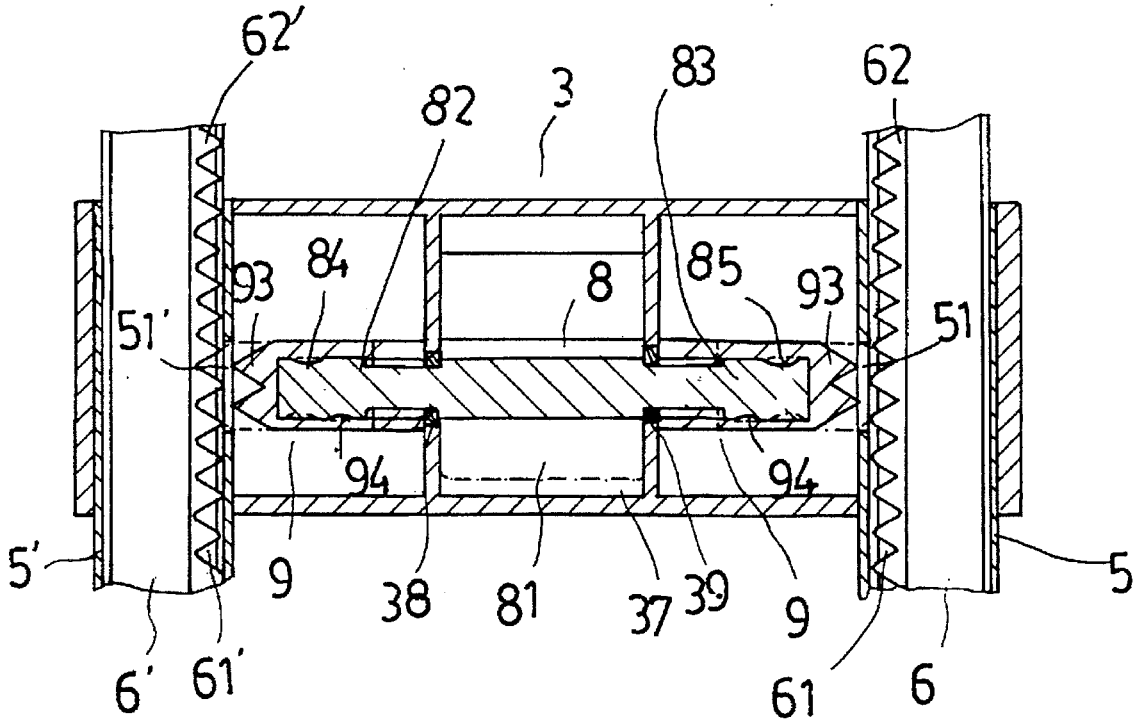
FIG. 5 is a sectional view of the upper part of FIG. 4.

Referring to FIG. 5 and FIGS. 3 and 4 again, the bottom mounting frame 4 comprises two casters 41 and 42 bilaterally disposed at the bottom, and two axle holders 43 and 44 bilaterally disposed at the top for receiving the sleeves 5 and 5'. The sleeves 5 and 5' are respectively fastened to the axle holders 43 and 44, each having a side through hole 51 or 51' near the top. The inner tubes 6 and 6' are respectively moved in the sleeves 5 and 5', each comprising a longitudinal groove 61 or 61', a rack 62 or 62' mounted in the longitudinal groove 61 or 61', and an end stop block 63 or 63' fixedly secured at the bottom end. The top mounting frame 3 comprises a control box 31, a back cover 36 covered on the back open side of the control box 31 and secured in place by screws 361, two vertical top holes 32 and 33 bilaterally disposed at the top, two vertical bottom holes 34 and 35 bilaterally disposed at the bottom and respectively linked to the vertical top holes 32 and 33, a front opening 37 in the middle, and two supporting members 38 and 39 at two opposite sides of the front opening 37. The vertical bottom holes 34 and 35 have a bigger diameter than the vertical top holes 32 and 33. The top ends of the sleeves 5 and 5' are respectively inserted into the vertical bottom holes 34 and 35 and stopped at the bottom ends of the vertical top holes 32 and 33. The inner tubes 6 and 6' are joined by the hand grip 7 outside the top mounting frame 3. When the inner tubes 6 and 6' are pulled out of the sleeves 5 and 5', the end stop blocks 63 and 63' are stopped at the bottom ends of the vertical top holes 32 and 33, and therefore the inner tubes 6 and 6 do not disconnect from the sleeves 5 and 5' The control bar 8 is mounted in the control box 31 of the top mounting frame 3 and supported on the supporting members 38 and 39, comprising a finger strip 81 in the middle, two cylindrical end blocks 82 and 83 at two opposite ends, and two symmetrical spiral grooves 84 and 85 respectively made around the cylindrical end blocks 82 and 83. The locating blocks 9 are respectively covered on the cylindrical end blocks 82 and 83 of the control bar 8, each comprised of a left half 91 and a right half 92. The left half 91 and the right half 92 have a respective pin hole 95 or 96. By fitting a pin 97 into the pin holes 95 and 96, the left hair 91 and the right half 92 are connected together. The left half 91 has a toothed projection 93 meshed with the rack 62', and a raised portion 94 engaging one spiral groove 84 or 85. When the control bar 8 and the locating blocks 9 are installed in the control box 31 of the top mounting frame 3, the finger strip 81 of the control bar 8 extends out of the front opening 37 of the control box 31 for turning by hand.

Referring to FIG. 5 again, when turning the finger strip 81 in one direction, the locating blocks 9 are moved toward each other along the spiral grooves 84 and 85 on the cylindrical end blocks 82 and 83 of the control bar 8 to release the toothed projections 93 from the racks 62 and 62', and therefore the inner tubes 6 and 6' can be moved out of the sleeves 5 and 5' by the hand grip 7 to the desired distance. When the inner tubes 6 and 6' are extended out of the sleeves 5 and 5' to the desired distance, the finger strip 81 is turned in the reversed direction to move the locating blocks 9 outward, the toothed projections 93 are forced into the side through holes 51 and 51' on the sleeves 5 and 5' into engagement with the racks 62 and 62' again, and therefore the inner tubes 6 and 6' are locked in position.

I claim:

1. A retractable handle positioning structure comprising: a transverse top mounting frame and a transverse bottom mounting frame configured to be fixedly secured to one side of a luggage piece at different elevations; first and second sleeves fixedly connected to and extending between said transverse top mounting frame and said transverse bottom mounting frame; first and second inner tubes slidably located in said first and second sleeves and extending through openings in said transverse top mounting frame; a hand grip connected to said first and second inner tubes and located outside of said top mounting frame; a rack mounted to each of said first and second inner tubes; a from opening formed in said top mounting frame; support means mounted at two opposite sides of said from opening; a control bar supported by said supporting means on said top mounting frame and rotatable about an axis, said control bar comprising a finger strip in a middle portion thereof extending through the front opening, a cylindrical end block at each opposite end with the axis of the cylindrical end blocks aligned with the axis of rotation, and spiral grooves formed around said cylindrical end blocks; two locating blocks respectively engaged with said spiral grooves around said cylindrical end blocks, each locating block having a toothed projection engageable through an opening in one of said sleeves with the rack on one of said first and second inner tubes and a raised portion positioned for engagement with the spiral groove on one of said cylindrical end blocks of said control bar; wherein the toothed projection of each locating block is disengaged from the racks of said inner tubes for permitting said inner tubes to be slidably moved with respect to said sleeves when said control bar is turned in a first direction with respect to the axis of rotation to retract the two locating blocks, and the toothed projection of each locating block is engaged with the racks of said first and second inner tubes to prevent slidable movement of said first and second inner tubes relative to said sleeves when said control bar is turned in a second direction with respect to the axis of rotation.

* * * * *